US007775200B2

(12) United States Patent
Anderson

(10) Patent No.: US 7,775,200 B2
(45) Date of Patent: Aug. 17, 2010

(54) BARREL SYSTEM FOR A PAINTBALL MARKER

(76) Inventor: Kenneth K. Anderson, 1915 Yacht Maria, Newport Beach, CA (US) 92660

( * ) Notice: Subject to any disclaimer, the term of this patent is extended or adjusted under 35 U.S.C. 154(b) by 476 days.

(21) Appl. No.: 11/134,762

(22) Filed: May 23, 2005

(65) Prior Publication Data

US 2006/0260597 A1 Nov. 23, 2006

(51) Int. Cl.
*F41A 21/02* (2006.01)

(52) U.S. Cl. ..... 124/83; 42/76.01; 42/76.02; 89/16

(58) Field of Classification Search ..... 124/83; 42/76.02, 78, 76.01, 77; 89/14.05, 16, 15, 89/14.7

See application file for complete search history.

(56) References Cited

U.S. PATENT DOCUMENTS

| | | | | | |
|---|---|---|---|---|---|
| 2,828,579 | A | * | 4/1958 | Schwerbel et al. | 446/19 |
| 2,847,786 | A | * | 8/1958 | Day et. al. | 42/76.01 |
| 3,229,583 | A | * | 1/1966 | Long et al. | 89/14.05 |
| 3,472,218 | A | | 10/1969 | La Mers | |
| 4,485,721 | A | | 12/1984 | Shankhla et al. | |
| 4,646,618 | A | | 3/1987 | Kurth et al. | |
| 4,674,217 | A | * | 6/1987 | Matievich | 42/76.01 |
| 4,685,236 | A | * | 8/1987 | May | 42/76.02 |
| 4,843,946 | A | | 7/1989 | Gladstone et al. | |
| 5,214,234 | A | * | 5/1993 | Divecha et al. | 89/16 |
| 5,228,427 | A | * | 7/1993 | Gardner, Jr. | 124/71 |
| 5,600,912 | A | * | 2/1997 | Smith | 42/76.01 |
| 5,804,756 | A | * | 9/1998 | Christensen | 89/15 |
| 5,915,937 | A | * | 6/1999 | Christensen | 42/76.02 |
| 6,189,431 | B1 | * | 2/2001 | Danner et al. | 89/16 |
| D440,262 | S | * | 4/2001 | Fernandez et al. | D21/570 |
| 6,295,752 | B1 | * | 10/2001 | Havlock | 42/76.01 |
| 6,457,274 | B2 | * | 10/2002 | Smith | 42/76.02 |
| 6,662,797 | B1 | | 12/2003 | Freeman et al. | |
| 6,889,464 | B2 | * | 5/2005 | Degerness | 42/76.02 |
| 7,076,905 | B2 | * | 7/2006 | Zouboulakis | 42/76.01 |
| 2001/0050077 | A1 | * | 12/2001 | Sullivan, Jr. | 124/84 |
| 2004/0089281 | A1 | * | 5/2004 | Martinez | 124/82 |
| 2004/0244257 | A1 | * | 12/2004 | Degerness | 42/76.02 |
| 2005/0247295 | A1 | * | 11/2005 | Judson | 124/83 |
| 2006/0027223 | A1 | * | 2/2006 | Vasel et al. | 124/57 |
| 2007/0125351 | A1 | * | 6/2007 | Campo et al. | 124/56 |

FOREIGN PATENT DOCUMENTS

| | | |
|---|---|---|
| CH | 682843 | 11/1993 |
| GB | 766787 | 1/1957 |

* cited by examiner

*Primary Examiner*—Benjamin P Lee
(74) *Attorney, Agent, or Firm*—Morland C. Fischer

(57) ABSTRACT

A barrel system for a paintball marker including a breach removably connected to the paintball marker and a composite front detachably connected to the breach. The composite front of the barrel system includes a hollow bore through which a paintball is propelled, a non-metallic inner layer surrounding the bore, and a non-metallic outer layer surrounding the inner layer. The non-metallic inner layer is preferably manufactured from a plurality of unidirectional graphite fibers embedded within an epoxy resin. The non-metallic outer layer is preferably manufactured from a plurality of graphite fibers that are woven together and embedded with an epoxy resin for surrounding and reinforcing the inner layer. The non-metallic inner layer of the composite front is smoothly and continuously tapered to cause the hollow bore to be tapered from a relatively narrow diameter to a relatively wide diameter in the direction of travel of the paintball.

16 Claims, 3 Drawing Sheets

BARREL SYSTEM FOR A PAINTBALL MARKER

BACKGROUND OF THE INVENTION

1. Field of the Invention

This invention relates to a barrel system to be detachably connected to a paintball marker wherein the front or tip of the barrel system includes a taper and is manufactured with a plurality of unidirectional and/or woven (e.g., graphite) fibers embedded within an (e.g., epoxy) resin.

2. Background Art

The game of paintball is growing in popularity. Participants use pressurized gas paintball markers to propel paintballs down a barrel system and towards a target or each other. Because paintballs come in various sizes and shapes, and because paintballs are susceptible to the effects of temperature, humidity, and the like, it is known for a paintball marker to have either a continuous one-piece barrel system or a two-piece barrel system including an interchangeable breach that is mated to an interchangeable front to account for the different characteristics of the paintballs and/or to change the overall length of the barrel system.

Conventional barrel systems are commonly manufactured from metal (e.g., extruded bar stock or drilled from aluminum). As a consequence of the metallic barrel system, a paintball is subjected to high friction forces, particularly as it travels down a one-piece barrel system. Thus, the velocity at which the paintball exits the front of the barrel system is typically reduced. Moreover, the metallic barrel system may contain grooves or other imperfections that are introduced during machining which can sometimes impart a spin to the paintball that may alter its direction and adversely affect the aim of the player. Metallic one-piece barrel systems and two-piece barrel systems (at the front or the interface between the front and the breach) are known to include a step-wise taper to reduce pressure and improve accuracy. However, such a step-wise taper is very abrupt for a rapidly moving paintball. Thus, the paintball may experience turbulence as it exits the front of the barrel system giving the player less accuracy and control.

In other cases, certain one-piece barrel systems and the front of certain other two-piece barrel systems have been manufactured with a non-metallic woven mesh liner surrounding a hollow bore through which the paintball is propelled. The texture of the mesh liner may cause the fragile gelatin capsule around the paintball to rupture and thereby allow paint to be spilled along the bore. The texture of the mesh liner also makes it difficult to clean the breach and remove the paint from the bore thereof.

Accordingly, what would be desirable is an interchangeable barrel system for a paintball marker that is adapted to improve performance, accuracy and control, while enabling the bore to be easily cleaned in the event of paintball failure.

One example of a barrel system for a paintball marker having a metallic breach or back with a uniformly decreasing taper extending therealong is available by referring to U.S. Pat. No. 6,295,752 to Havlock.

SUMMARY OF THE INVENTION

In general terms, an interchangeable barrel system is disclosed to be detachably connected to paintball marker which is adapted to receive a supply of paintballs from a hopper to be propelled by means of gas under pressure through the barrel system. The barrel system includes a metallic breach or back and a composite front or tip. The composite front carries a metallic coupler at one end thereof having a screw fitting that is capable of being mated to a corresponding screw fitting of the breach.

According to a preferred embodiment, the composite front of the barrel system includes a relatively thick inner layer and a relatively thin outer layer. The inner layer surrounds a hollow bore of the barrel system through which a paintball is propelled. The inner layer of the composite front has a plurality of parallel aligned, unidirectional (e.g., graphite) fibers extending in the direction of the longitudinal axis of the bore. The unidirectional fibers are embedded within an (e.g., epoxy) resin. The inner layer of the composite barrel system front reduces friction, maximizes speed and directional stability, and improves the accuracy for a paintball traveling down the barrel towards a target. The unidirectional fibers also allow the hollow bore to be easily cleaned should the paintball accidentally rupture and spill its paint. To enable the paintball to float as it exits the barrel system front towards the target and thereby reduce turbulence and drag, the inner layer of the front is tapered. More particularly, the inner layer is uniformly tapered along the length thereof, so as to cause the hollow bore through the barrel system to increase from a relatively narrow diameter to a relatively wide diameter in the direction of travel of the paintball through the bore. In an alternate embodiment, the inner and outer layers are of constant thickness, and the front of the barrel system is flared outwardly to cause the diameter of the hollow bore to increase from relatively narrow to relatively wide in the direction of paintball travel.

The outer layer of the composite front is formed from a plurality of (e.g., graphite) fibers that are woven together as a mesh surrounding the inner layer. The fiber weave of the outer layer surrounding the inner layer provides a lightweight structural reinforcement around the inner layer and establishes a textured exterior surface to enhance the look and feel of the barrel system. In another alternate embodiment, the woven fibers can run through a relatively thick inner layer surrounding the bore, and the unidirectional fibers can run through a relatively thin outer layer surrounding the inner layer. Similarly, the inner and outer layers can be replaced by a single layer having all unidirectionally extending fibers or all woven fibers running therethrough.

DESCRIPTION OF THE PREFERRED EMBODIMENT

Figure 1:
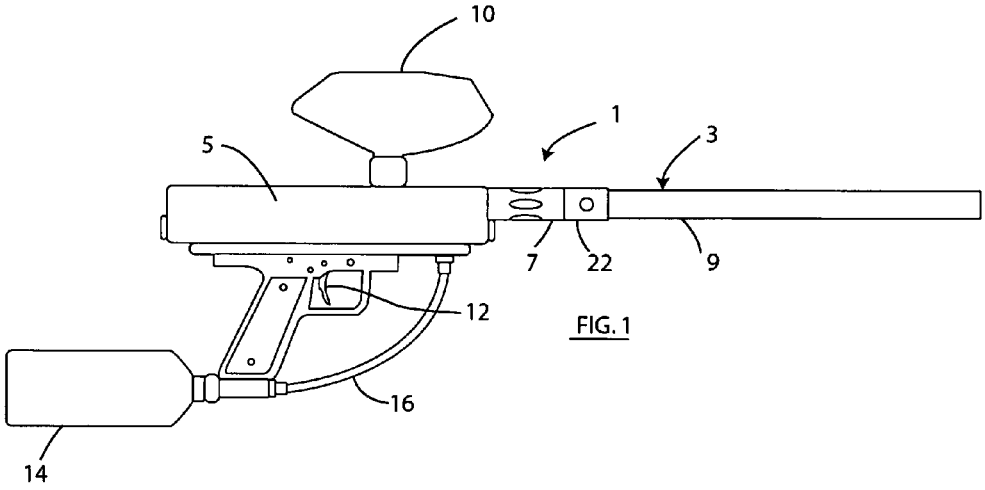
FIG. 1 shows a paintball marker having the barrel system of the present invention detachably connected thereto.
Figure 2:
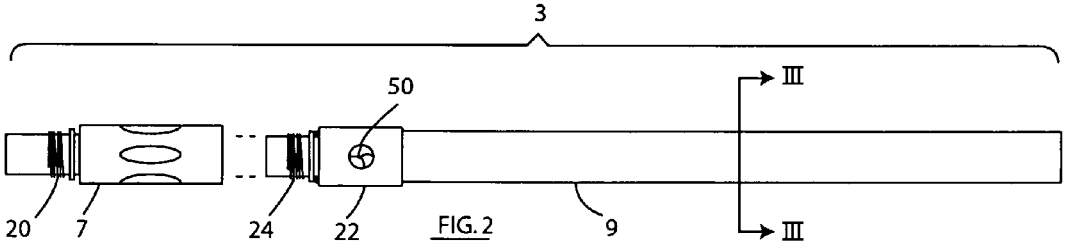
FIG. 2. shows the barrel system of FIG. 1 with a breach and a composite front thereof disconnected from one another.

An improved barrel system 3 for a paintball marker 1 according to a preferred embodiment of this invention is described while referring initially to FIGS. 1 and 2 of the drawings. FIG. 1 shows the barrel system 3 removably connected to a body 5. FIG. 2 shows the barrel system 3 removed from the body 5. In this regard, the barrel system 3 of paintball marker 1 includes a hollow breach 7 located at the rear end thereof and a hollow front or tip 9 located at the opposite end and detached from the breach 7.

Like conventional paintball markers, the paintball marker 1 of FIG. 1 includes a hopper 10 into which a supply of paintballs (not shown) is loaded so as to be dispensed, under pressure, via the bore of the barrel system 3. Paintballs from the hopper 10 are delivered into the body 5 to be propelled through the barrel system 3 when a trigger 12 is activated by a player. To this end, a propellant tank 14 that is filled with a source of gas under pressure (e.g., typically compressed air or carbon dioxide) communicates with the body 5 by means of tubing 16. The pressurized gas within propellant tank 14 provides the driving force to propel paintballs through the breach 7 and front 9 of barrel system 3 when the player depresses the trigger 12.

Also like conventional paintball markers, the breach (or back) 7 of the barrel system 3 of FIG. 2 is manufactured from aluminum or another suitable lightweight material. A screw fitting 20 is formed at the distal end of breach 7 to enable the breach to be removably connected to the body 5 of paintball marker 1. As will be known to those skilled in the art, the breach 7 provides a controlled glide area that is sized to snuggly engage the paintballs being propelled through the barrel system 3 in order for the paintballs to build up speed. Therefore, the breach 7 is often interchangeable with other breaches having a variety of bore dimensions to correspond with different sizes of the paintballs to be loaded into the hopper 10.

In accordance with a first improvement of the present invention, the front (or tip) 9 of the barrel system 3 is manufactured from a non-metallic (i.e., composite) material, so as to be characterized by light weight and a low coefficient of thermal expansion. A metallic (e.g., aluminum) coupler 22 is located at the distal end of the front 9. The coupler 22 is provided with a screw fitting 24 that is adapted to be mated to a corresponding threaded receptacle (not shown) formed at the proximal end of the breach 7 whereby the front 9 is detachably connected to the breach 7 to complete the barrel system 3 of the paintball marker 1. That is, like the breach 7 of barrel system 3, it may be desirable that the front 9 also be interchangeable with other fronts having a variety of bore dimensions depending upon the desired overall length of the barrel system and/or the size of the paintballs to be propelled through the barrel system.

Figure 3:
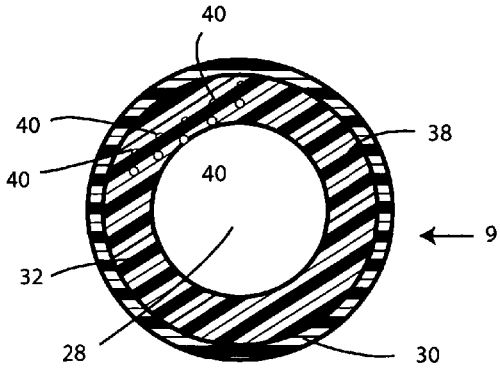
FIG. 3 is a cross-section of the composite front of the barrel system taken along lines 3-3 of FIG. 2.
Figure 4:
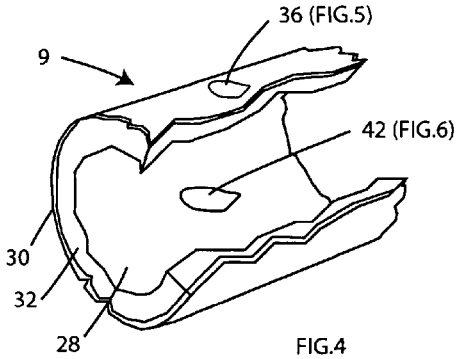
FIG. 4 shows a partial broken-away perspective view of the composite front of the barrel system.

Turning now to FIGS. 3 and 4 of the drawings, details are provided of the non-metallic, composite front 9 of the barrel system 3 to be detachably connected to the body 5 of paintball marker 1 by way of the breach 7. The composite front 9 of barrel system 3 includes a hollow, longitudinally extending bore 28 (best shown in FIG. 7) that is surrounded by a relatively thin outer layer 30 and a relatively thick inner layer 32. The precise diameters of the hollow bore 28 and the outer and inner layers 30 and 32 of the barrel system front 9 will depend upon the size of the paintball to be propelled therethrough.

Figure 5:
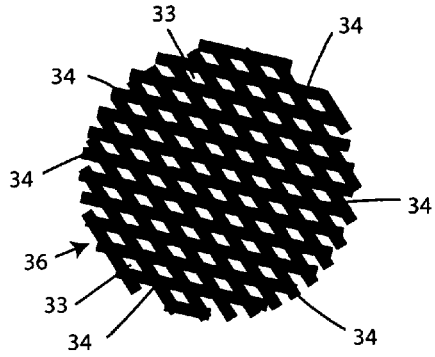
FIG. 5 is an enlarged detail of the fiber pattern taken from an outer layer of the composite front of FIG. 4.

More particularly, the outer layer 30 of the composite front 9 of barrel system 3 is preferably formed from an (e.g., epoxy) resin material 33 that is reinforced by a plurality of (e.g., graphite) fibers 34 having a (e.g., 3 k) woven pattern 36 in the manner best illustrated in FIG. 5. The exterior fiber weave 36 of the barrel system front 9 forms a mesh that provides a structural reinforcement around the inner layer 32 to resist deformation caused by abuse during play and by the paintballs being propelled through bore 28 in response to pressurized gas from the propellant tank 14 (of FIG. 1). Moreover, the exterior graphite weave 36 provides a textured surface that enhances the aesthetic appearance and feel of the barrel system 3.

The inner layer 32 of the composite front 9 of the barrel system 3 of FIGS. 1 and 2 is preferably formed from an (e.g., epoxy) resin material 38 that is reinforced by a plurality of continuous (e.g., graphite) fibers 40 embedded therewithin. As an important aspect of this improvement, the graphite fibers 40 that are embedded within the resin material 38 of inner layer 32 extend in generally parallel alignment relative to one another in a unidirectional pattern 42 in the manner best illustrated in FIG. 6. In this case, the unidirectional fibers 40 run continuously and longitudinally through the barrel system front 9 in a direction corresponding to the longitudinal axis of the bore 28.

Figure 6:
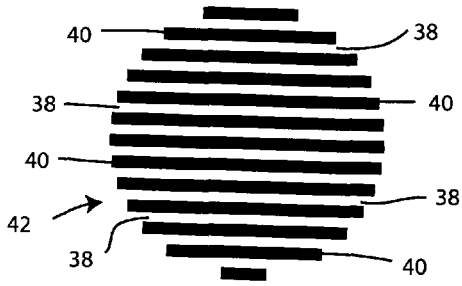
FIG. 6 is an enlarged detail of the fiber pattern taken from an inner layer of the composite front of FIG. 4.

By virtue of the unidirectional fiber pattern 42 of the inner layer 32 of the composite barrel system front 9, a paintball is provided with a uniform straight line direction as it moves through the hollow bore 28 so as to improve accuracy to a target. What is more, the friction to which the paintball will be exposed as it travels down the barrel system front 9 is advantageously reduced. In this same regard, the unidirectional fiber pattern 42 of FIG. 6 is less likely to trap paint than a conventional metallic front or a woven fiber front should a paintball accidentally rupture within the bore 28. Thus, the bore of the composite barrel system front 9 herein disclosed can be cleaned more easily than the typical metallic front inasmuch as the unidirectional fiber pattern 42 helps to guide the paint down the bore. In fact, it has been found that most of the paint can be blown out of the bore by simply "shooting through" during play with the paintballs pushing the paint through and out of the barrel system.

While the woven fibers 34 of outer layer 30 and the unidirectional fibers 40 of inner layer 32 of the composite barrel system front 9 have been described herein as graphite fibers, it is to be expressly understood that such fibers can also be manufactured from other suitable non-metallic material (e.g., fiberglass) or lightweight metallic material. Moreover, while the woven fibers 34 of outer layer 30 and the unidirectional fibers 40 of inner layer 32 have been described herein as being embedded in an epoxy resin, other suitable resins, plasticides, and the like, may be substituted therefor.

Figure 7:
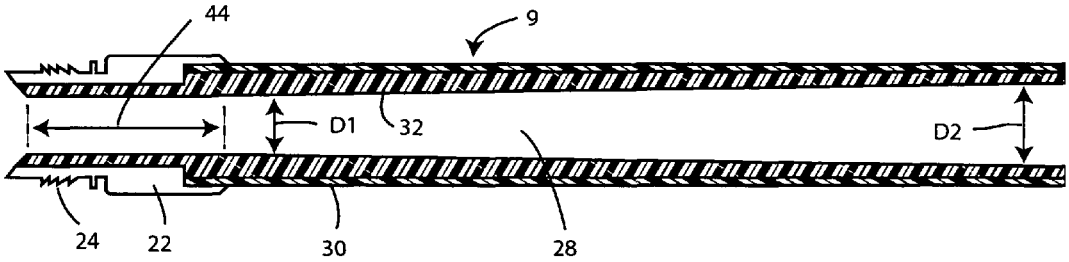
FIG. 7 is a cross-section of the composite front of the barrel system to illustrate one embodiment of a tapered bore running therethrough.

In accordance with another improvement of the present invention, reference is made to FIG. 7 of the drawings where a cross-section is shown to illustrate a tapered configuration of the bore 28 through the composite front 9 of the barrel system 3 of the paintball marker 1 of FIG. 1. As was earlier described while referring to FIGS. 3-6, the composite barrel system front 9 includes a hollow bore 28 that is surrounded by a relatively thin outer layer 30 having a woven fiber pattern (designated 36 in FIG. 5) and a relatively thick inner layer having a unidirectional fiber pattern (designated 42 in FIG. 6). The metallic (e.g., aluminum) coupler 22 is shown at the distal end of front 9 including screw threads 24 by which the front is detachably connected (i.e., screwed) to the breach 7 of the barrel system 3 of FIG. 2.

The outer layer 30 has a constant thickness along the length of the barrel system front 9. Likewise, a distal region 44 of the inner layer 32 has a constant thickness below the coupler 22. However, the remainder of the inner layer 32 after region 44 is uniformly and smoothly tapered therealong so that the hollow bore 28 through the barrel system front 9 is correspondingly tapered. As an important aspect of this improvement, the inner layer 32 tapers continuously and longitudinally from wide to narrow so that the diameter D1 of the bore 28 at the distal end of the front 9 is smaller than the diameter D2 of the bore 28 at the proximal end of the front 9 from which a paintball is ejected.

The precise dimensions of the diameters D1 and D2 at the respective distal and proximal ends of the barrel system front 9 will depend upon the size of the paintball to be propelled therethrough and the length of the front 9. By way of example only, for a 10 inch front, the diameter D1 at the distal end of front 9 is 0.697 inches, and the diameter D2 at the proximal end of front 9 is increased to 0.700 inches.

By way of further example, the tapered inner layer 32 of the composite barrel system front 9 is formed by being wrapped around a tapered mandrel (not shown). A set of different mandrels having different tapers can be used to impart correspondingly different tapers to a variety of different fronts which, as earlier described, are interchangeable with one another to be able to vary the overall length of the barrel system and/or accommodate paintballs having different sizes or shapes.

By virtue of the tapered front 9 of the barrel system 3 of FIG. 2, a paintball traveling through the bore 28 of barrel system 3 will fit closely within the distal region 44 of the front 9 as the paintball emerges from the breach 7. As the diameter of the bore 28 expands from distal region 44 towards the proximal end of the front 9, the paintball will gradually begin to float so that drag on the paintball will be reduced. Thus, the speed and direction of the paintball will not be adversely affected as the paintball is propelled towards a target from the proximal end of the barrel system front 9. In this same regard, the paintball will be subjected to less turbulence as it travels the length of the front 9 than it might otherwise feel as a consequence of step-wise tapers that are often employed in conventional metallic one-piece and certain two-piece barrel system fronts. Therefore, the paintball marker 1 including the composite front of the barrel system 3 herein disclosed can be characterized by maximized shooting accuracy and paintball speed.

The front 9 of the barrel system 3 of the paintball marker 1 as described herein is typically an elongated cylinder having a corresponding hollow longitudinally extending bore 28. A player may wish to have readily available a variety of fronts 9 having different lengths and bore diameters so as to vary the overall length of the barrel system and/or accommodate paintballs of different sizes or shapes. Such a variety of cylindrical fronts are known to roll over and even fall off a flat surface. To prevent the rolling displacement of the cylindrical barrel system fronts 9, one or more raised bumps or domes 50 (best shown in FIG. 2) projects upwardly from the coupler 22. Each raised bump or dome 50 functions as a stop to prevent the continuous rolling movement of the barrel system front 9 over a flat surface prior to its detachable connection at the screw fitting 24 of coupler 22 to an associated breach 7.

Figure 8:
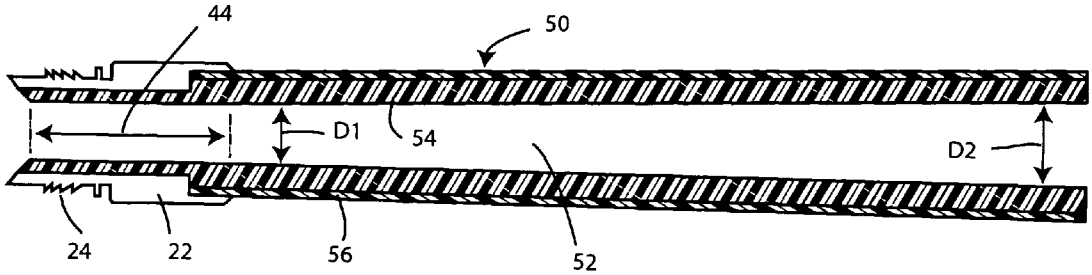
FIG. 8 is a cross-section of the composite front of the barrel system to illustrate another embodiment of a tapered bore running therethrough.

FIG. 7 of the drawings shows the front 9 of the barrel system 3 (of FIG. 1) including a tapered bore 28, an inner layer 32 having a uniformly tapered region therealong, and an outer layer 30 surrounding the inner layer 32 and having a constant thickness. FIG. 8 of the drawings shows the front 50 of a barrel system having a tapered bore 52 and inner and outer layers 54 and 56 which are each of constant thickness. In this case, the barrel system front 50 is flared outwardly beyond the distal region 44 that is surrounded by coupler 22. By virtue of its flared configuration, and like the bore 28 of the barrel system front 9 shown in FIG. 7, the bore 52 of the barrel system front 50 of FIG. 8 tapers continuously and longitudinally from narrow to wide so that the diameter D1 of the bore 52 at the distal end of the front 50 is smaller than the diameter D2 of the bore 52 at the proximal end of the front 50 from which a paintball is ejected.

Figure 9:
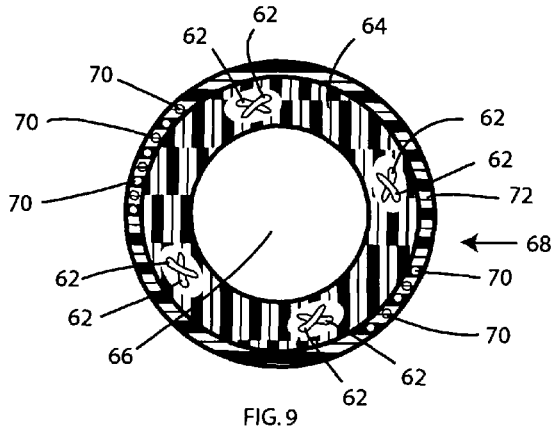
FIGS. 9-11 show alternate fiber patterns running through the composite front of the barrel system.
Figure 10:
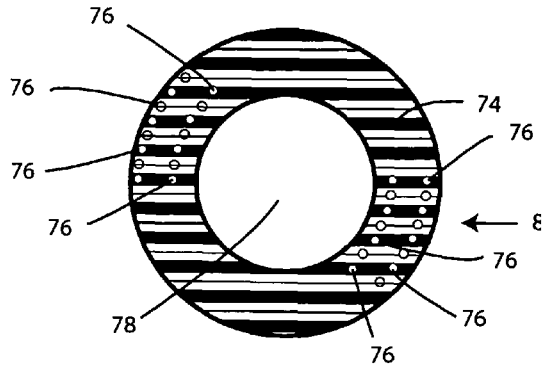
Figure 11:
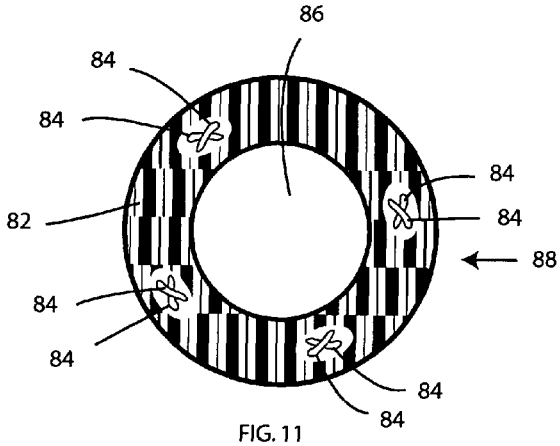

FIGS. 9-11 of the drawings show alternate fiber patterns that can be substituted for the fiber patterns that were previously described while referring to FIGS. 3-6. More particularly, in the barrel system front 9 shown in FIGS. 3-6, a hollow bore 28 is surrounded by a relatively thick epoxy inner layer 32 having unidirectional fibers 40 running therethrough and a relatively thin epoxy outer layer 30 having fibers 34 arranged in a woven pattern therethrough. However, the inner and outer layers 32 and 30 surrounding the bore 28 in FIGS. 3-6 can be reversed in FIG. 9, such that the fibers 62 which are woven together run through a relatively thick non-metallic (e.g., epoxy) inner layer 64 that surrounds the hollow bore 66 of the barrel system front 68, and the unidirectional fibers 70 run through a relatively thin non-metallic (e.g., epoxy) outer layer 72 that surrounds inner layer 64.

Alternatively, and as is best shown in FIG. 10, the former inner and outer layers are replaced by a single non-metallic layer 74 having unidirectional fibers 76 running therethrough and surrounding the hollow bore 78 of the barrel system front 80. In this same regard, and as is best shown in FIG. 11, the inner and outer layers can also be replaced by a single non-metallic layer 82 having woven fibers 84 running therethrough and surrounding the hollow bore 86 of the barrel system front 88.

I claim:

1. A paintball marker from which a paintball is to be propelled, said paintball marker comprising a hopper in which paintballs are stored, a hollow breech communicating with said hopper to receive a paintball therefrom and a barrel having a first end to be detachably connected to said breech and an opposite exit end from which the paintball is ejected from the paintball marker towards a target, said barrel having a hollow bore with a length extending from said breech to the opposite exit end of said barrel to provide a guide path along which the paintball travels and a layer of non-metallic material surrounding said bore, wherein at least a portion of said hollow bore is continuously and uniformly tapered from relatively narrow to relatively wide in the direction of travel of the paintball towards the target, the continuously and uniformly tapered portion of said hollow bore extending uninterrupted for at least half the length of said bore, and a plurality of non-metallic fibers embedded within the layer of non-metallic material surrounding said bore.

2. The paintball marker recited in claim 1, wherein said plurality of non-metallic fibers extend unidirectionally through the layer of non-metallic material surrounding said bore.

3. The paintball marker recited in claim 2, wherein said plurality of unidirectional fibers of said layer of non-metallic material are arranged in parallel alignment with one another in the direction of the longitudinal axis of said bore.

4. The paintball marker recited in claim 2, wherein said plurality of unidirectional fibers run continuously through said layer of non-metallic material.

5. The paintball marker recited in claim 2, wherein said plurality of unidirectional fibers of said layer of said non-metallic material are manufactured from graphite.

6. The paintball marker recited in claim 2, wherein said layer of non-metallic material surrounding said bore within which said plurality of unidirectional fibers are embedded is a resin.

7. The paintball marker recited in claim 1, wherein said layer of non-metallic material surrounding said bore includes a plurality of woven fibers running therethrough.

8. The paintball marker recited in claim 1, further comprising a metallic coupler surrounding the first end of said barrel, said metallic coupler enabling the first end of said barrel to be detachably connected to said breech.

9. The paintball marker recited in claim 8, also including a bump projecting outwardly from said metallic coupler to prevent said barrel from rolling over a flat surface.

10. The paintball marker recited in claim 1, further comprising a coupler carried by said barrel to enable said barrel to be detachably connected to said breech, said hollow bore extending through each of said coupler and said barrel, and the uniformly tapered portion of said hollow bore extending completely through said barrel from said coupler.

11. The paintball marker recited in claim 1, wherein the continuously and uniformly tapered portion of said hollow bore has the same shape at each cross section along the entire length thereof.

12. A paintball marker from which a paintball is propelled, said paintball marker comprising a hopper in which paintballs are stored, a hollow breech communicating with said hopper to receive a paintball therefrom and a barrel detachably connected to said breech, said barrel having a hollow bore along which a paintball travels, wherein at least a portion of said hollow bore is continuously and uniformly tapered from relatively narrow to relatively wide in the direction of travel of the paintball towards the target, the continuously and uniformly tapered portion of said hollow bore extending uninterrupted for at least half the length of said bore, an inner layer surrounding said bore, and an outer layer surrounding said inner layer, one of said inner and outer layers of said barrel having a plurality of unidirectional fibers embedded in a non-metallic material and the other one of said inner and outer layers of said front having a plurality of fibers that are woven together and embedded in a non-metallic material, said tapered bore having the same shape at each cross section along the length thereof.

13. The paintball marker recited in claim 12, wherein the continuously and uniformly tapered hollow bore of said barrel tapers from relatively narrow to relatively wide in the direction of travel of the paintball.

14. The paintball marker recited in claim 12, wherein said barrel has a front at one end thereof through which the paintball is ejected and a coupler at the opposite end to enable said barrel to be detachably connected to said breech, said hollow bore extending through each of said front and said coupler, and the uniformly tapered portion of said hollow bore extending completely through said front from said coupler.

15. A paintball marker from which a paintball is to be propelled, said paintball marker comprising a body at which a supply of paintballs is carried and a barrel, said barrel having a first end, a coupler located at said first end to be detachably connected to said body to receive a paintball therefrom, an opposite end, and an exit opening at said opposite end from which the paintball is directed towards a target, said barrel having a hollow bore with a length extending from the coupler at said first end to the exit opening at said opposite end to provide a guide path along which the paintball travels from said body, and a layer of non-metallic material surrounding said bore, wherein at least a portion of said hollow bore is continuously and uniformly tapered from relatively narrow to relatively wide in the direction of travel of the paintball towards the target, the continuously and uniformly tapered portion of said hollow bore extending uninterrupted for at least half the length of said bore.

16. The paintball marker recited in claim 15, wherein the continuously and uniformly-tapered portion of said hollow bore of said barrel extends for the entire length of said bore.

* * * * *